United States Patent [19]

Auer, Jr.

[11] 4,007,897

[45] Feb. 15, 1977

[54] CONTROL SYSTEM FOR MONITORING VEHICLE PASSAGE AT PREDETERMINED LOCATIONS

[75] Inventor: John H. Auer, Jr., Fairport, N.Y.

[73] Assignee: General Signal Corporation, Rochester, N.Y.

[22] Filed: Sept. 9, 1975

[21] Appl. No.: 611,742

[52] U.S. Cl. ..... 246/187 B; 104/88; 104/149; 104/155; 246/63 R

[51] Int. Cl.[2] ..... B61L 23/00

[58] Field of Search ..... 104/88, 149, 155; 198/34, 38; 214/16.4; 246/2 R, 2 F, 2 S, 30, 34 R, 34 CT, 63, 167 R, 167 D, 182 R, 182 C, 187 R, 187 B, 187 C, 108, 110; 340/23, 31, 37; 343/6.5 LC, 7.5

[56] References Cited

UNITED STATES PATENTS

| | | | |
|---|---|---|---|
| 3,263,073 | 7/1966 | Westerweel | 246/30 |
| 3,263,625 | 8/1966 | Midis et al. | 104/88 |
| 3,268,727 | 8/1966 | Shepard | 246/187 R |
| 3,451,350 | 6/1969 | Bryson | 104/88 |
| 3,731,088 | 5/1973 | Grundy et al. | 246/182 B |
| 3,734,433 | 5/1973 | Metzner | 246/187 B X |
| 3,748,466 | 7/1973 | Sibley et al. | 246/63 C |
| 3,771,463 | 11/1973 | Smoot et al. | 104/149 X |
| 3,774,025 | 11/1973 | Auer, Jr. et al. | 246/63 A |
| 3,780,666 | 12/1973 | Perrott | 104/88 |
| 3,788,232 | 1/1974 | Schneider et al. | 104/88 |
| 3,790,779 | 2/1974 | Paddison | 246/182 C |
| 3,808,427 | 4/1974 | Malon et al. | 246/63 R |
| 3,842,746 | 10/1974 | Kleven | 246/182 R X |

*Primary Examiner*—Stephen G. Kunin
*Attorney, Agent, or Firm*—Pollock, Vande Sande & Priddy

[57] ABSTRACT

A vehicle control system monitors vehicle passage at predetermined locations. Each time a vehicle passes a predetermined location a window is created for passage of that vehicle at the next predetermined location. So long as the vehicle actually passes the next location during the window the vehicle is allowed to continue its travel. As a further check each location ensures that safe separation is maintained between vehicles by allowing continued travel only if a minimum time separation is maintained. The system also responds to coupled vehicles by detecting that the time separation is below a predetermined value indicative of coupled vehicles and thus minimum time separation need not be enforced. In one embodiment, passage of a vehicle outside of a time window results in immediate protective action such as by de-energizing the power to each of the vehicles in the system to prevent violation of minimum safe separation rules. In another embodiment, however, vehicle detectors are spaced closely enough such that minimum safe headway requirements will not be violated even if vehicle passes outside a window.

19 Claims, 8 Drawing Figures

CONTROL SYSTEM FOR MONITORING VEHICLE PASSAGE AT PREDETERMINED LOCATIONS

BACKGROUND OF THE INVENTION

A wide variety of control systems are known in the art for safely controlling passenger carrying vehicles traversing a guideway or the like. One of the prime requirements of these systems is to avoid rear end type collisions. The conventional manner in which such collisions are avoided is by requiring a minimum safe headway between vehicles at all times. The minimum safe headway is computed such that if a preceding vehicle comes to an immediate stop, the following vehicle will, within the safe headway separation distance, be able to come to a safe stop without impacting the preceding vehicle. Those systems known in the prior art can be characterized as manual, semi-automatic and automatic systems. In each of these systems information is communicated to the vehicle, from equipment on the wayside, with regard to the actual separation between that vehicle and a leading vehicle. Based upon that information the following vehicle then can select the appropriate speed such that for the selected speed the actual headway corresponds to a safe stopping distance. This necessarily implies that each of the vehicles is capable of traveling at each of a predetermined plurality of speeds and can accurately be controlled to maintain that speed. The trend has been for the equipment to assume more and more responsibility and thus leave less and less responsibility for any operator, including systems in which the operator has actually been eliminated and thus the equipment itself assumes the responsibility for governing movement of the vehicle. As a result this equipment, especially in the case where no operator is present, necessary to maintain safe operation of the vehicle can be costly, complex and bulky. For systems in which each of the vehicles is large compared to the passenger load it carries this presents little or no difficulty. However, it is often desired to provide equipment for governing movement of vehicles in which prior art equipments would actually occupy a large percentage of space available on board the vehicle and thus render such a system uneconomic in that each of the vehicles would have restricted load carrying capacity. The reason for this large amount of equipment should be apparent to those familiar with the requirements imposed on this equipment. In particular, the equipment must be capable of receiving and decoding signals regarding specific desired speeds, translate the decoded information into controls for controlling the propulsion equipment on board the vehicle, in some cases transmit to the wayside the signals indicative of the condition of the equipment on board the vehicle, compare actual vehicle speed to the desired vehicle speed and control propulsion as well as braking equipment on board the vehicle to bring the two speeds into coincidence and accomplish all of the foregoing functions in a fail safe manner in which any failure of any equipment or portion thereof occurs in a manner to maintain the safety of the vehicle.

Those skilled in the art are aware that many of the aforementioned control systems known to the art are based upon vehicle detection as a result of the interaction between steel wheels riding on steel rails. However there is also a noticeable trend in the field for the use of vehicle-roadway combinations which do not provide this vehicle detection capability. Thus, for control systems in this context some other arrangement must be made for detecting the presence of a vehicle in a predetermined location.

It is therefore an object of the present invention to provide a control system in which the control equipment on board the vehicle is vastly simplified in comparison with that required in the prior art. It is another object of the present invention to provide such a control system in which the simplified control apparatus on board the vehicle eliminates the necessity for on-board failure checking systems along with the attendant complexity of those components. It is still another object of the present invention to provide a control system of the foregoing type which is operative for combinations of vehicle and roadway which do not include a steel wheel-steel rail.

SUMMARY OF THE INVENTION

These and other objects of the invention are realized in the context of a synchronous type transportation system in which vehicles travel along a predetermined path or roadway supplied with power from the wayside. The vehicle contains little if any control equipment and the control system is based on the assumption that the vehicles travel at or near a predetermined speed. One implementation employs induction motors so that the vehicles tend to travel at or slightly below synchronous speed relative to the frequency of the power supplied. The control system verifies the correctness of this assumption by monitoring passage of vehicles at predetermined locations at which the presence of a vehicle can be detected. Each time a vehicle passes a predetermined location a window is created for passage of that vehicle at the next predetermined location. So long as the vehicle actually passes the next location during the window that had been created the vehicle is allowed to continue. To further ensure that safe separation is maintained between vehicles the system takes protective action if a minimum time separation between vehicles is not maintained. This latter requirement is assured by monitoring the time separation between a pair of vehicles passing a single predetermined point. In most cases if this time separation is below a minimum, protective action may be initiated. However, if the time separation is so short as to indicate that the two vehicles are actually coupled together no protective action is required. In one embodiment of the invention protective action is initiated upon the existence of single violation of these movement rules. In another embodiment of the invention expiration of a single violation may be safely forgiven so long as the predetermined points are spaced closely enough together so that minimum safe headway is assured.

BRIEF DESCRIPTION OF THE DRAWINGS

In the drawings appended hereto like reference characters identify identical apparatus and.

DETAILED DESCRIPTION OF PREFERRED EMBODIMENTS

Figure 1:
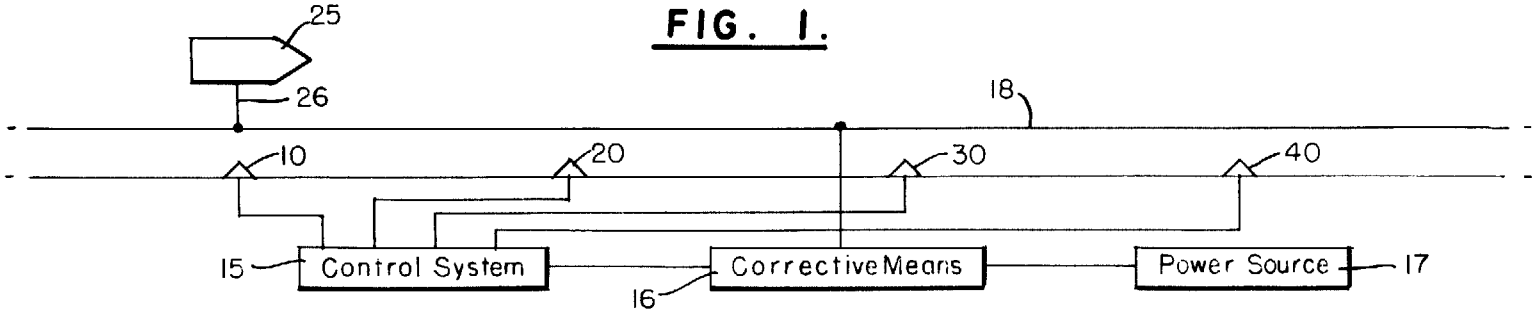
FIG. 1 is a block diagram of the inventive system.

FIG. 1 is a schematic representation of a portion of a path or roadway for a transportation system employing the inventive apparatus. In particular, a self-propelled vehicle 25 is adapted to travel along a predetermined path or roadway. By self-propelled I mean a vehicle which generates its own driving force. The energy for the driving force usually will be supplied from a source external to the vehicle. Vehicle 25 may be a wheeled or non-wheeled vehicle. Even if wheeled it need not employ steel wheels but may employ rubbered tired wheels or the like. The roadway itself need not provide rails or rail type equivalents and in fact can be a relatively smooth uninterrupted surface. Means are provided for supplying propulsion energy to the vehicle which may take the form of a third rail, overhead trolley or equivalent apparatus by which electrical energy is transferred from the wayside to the vehicle. Vehicle 25 is preferably equipped with electrical motors for converting electrical energy thereby supplied to the vehicle to exert a force on the roadway for propelling the vehicle. Spaced along the roadway at predetermined locations are vehicle detectors 10, 20, 30, 40 etc. Each of these detectors is connected to the control system 15. Although FIG. 1 illustrates this connection as being a wired connection those of ordinary skill in the art will understand that many other forms of connecting the vehicle detectors to the control system can be employed such as radio links, micro-wave links or a multiplexing arrangement in which each of the detectors and the control system is connected to a common conductor. For ease of explanation detailed reference to the specific manner of communication is omitted and those of ordinary skill in the art will understand that many types of modulation, coding, decoding, demodulation and the like can be employed within the spirit and scope of this invention. The control system 15 accepts information received from each of the vehicle detectors to monitor the performance of the system. If the information provided to the control system 15 indicates the assumption regarding correct vehicle speed is correct the vehicles are allowed to continue. On the other hand if information indicates the necessity for protective action the control system 15 provides a signal representing such protective action to corrective means 16. In one form of the invention corrective means 16 is connected between a power source 17 and a power transferring conductor 18. Propulsion energy is transferred from the power conductor 18 to each of the vehicles 25 by a brush 26 or equivalent. When safe operation is indicated protective means 16 maintains the circuit between the power source 17 and power transferring conductor 18 thereby enabling the vehicles to continue traveling along the roadway.

Figure 2:
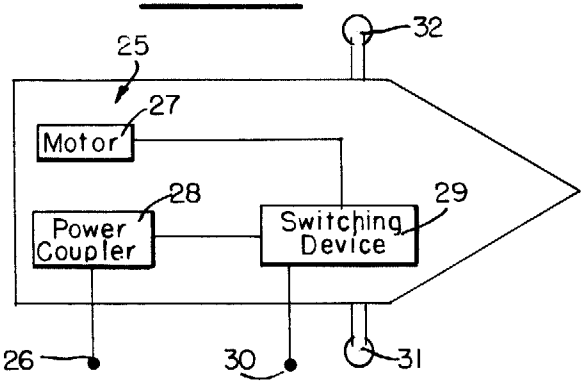
FIG. 2 is a schematic showing of vehicle carried equipment.

FIG. 2 is a schematic representation of a typical vehicle 25 and the equipment carried thereby. More particularly, vehicle 25 carries a propulsion motor 27 which, when supplied with electrical energy is capable of propelling the vehicle. As should be apparent to those skilled in the art multiple motors may be provided each supplied with energy in the manner to be explained hereinafter. Preferably the propulsion equipment maintains the vehicle at constant speed but is capable of accelerating and decelerating the vehicle. For example, motor or motors 27 may comprise induction motors the speed of rotation of which, and correspondingly the speed of the movement of the vehicle, depend upon the frequency of electrical energy supplied to the motor or motors 27. Such electrical energy may be supplied to the motor or motors 27 from the brush or the like 26 through a power coupler 28 connected to a switching device 29 and thence to the motors or motor 27. Switching device 29 has associated therewith an additional brush or the like 30, the purpose of which will be explained in more detail hereinafter. In addition to the foregoing apparatus each vehicle 25 is provided with an indicator and preferably a pair of indicators such as indicator 31 and 32. The indicators can take any of many forms so long as it is capable of indicating its presence to a wayside detector. More particularly, indicators 31 and 32 may comprise sources of electromagnetic energy such as inductive loops, radio antennas, magnets or electromagnets, visible or other forms of light or means which can cooperate with a source of the aforementioned type to affect the transmission of such electro-magnetic energy. In one embodiment, the indicators themselves comprise a source of electromagnetic energy and the detectors may be a receiver for the associated type of electro-magnetic energy. In another form of the invention the detectors 10, 20, 30, 40 etc. may actually comprise both a source of electromagnetic energy and a detector thereof; indicators 31 and 32 then cooperate to momentarily affect the quality of the transmission of such electro-magnetic energy from a source to the associated detector so as to indicate the presence of indicators 31 and 32. FIG. 2 illustrates that the vehicle 25 carries an indicator on each side of the vehicle which is preferable when the vehicle enters a switching area. However, those of ordinary skill in the art will understand that a single indicator will suffice for most situations.

Figure 3:
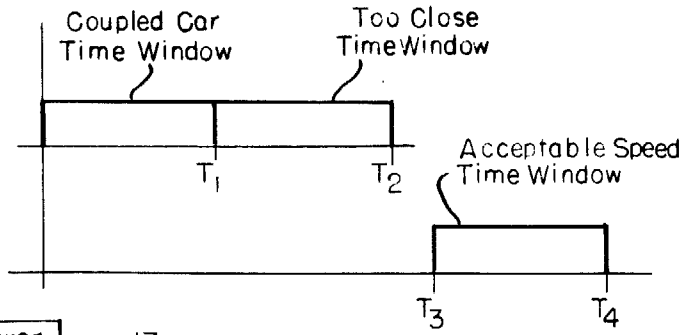
FIG. 3 is an exemplary time sequence of windows created by the inventive system.

By reason of the particular type propulsion employed by the vehicles traveling in the system, the vehicles will tend to travel at or near the same speed. So long as the vehicles, in fact, travel at the same speed and, assuming that the system initially maintained a safe separation between the vehicles then the vehicles will continue to maintain the same safe separation. Therefore, the control philosophy of the system is merely to monitor the performance of the vehicles to determine that each of them are traveling at or near the predetermined speed thereby assuring maintenance of safe separation between vehicles. To this end each time a vehicle passes a vehicle detector a plurality of "windows" are created in the control system. The first window, the acceptable speed time window (hereinafter ASTW) is created for the detector next in line along the pathway. If the vehicle passes the next vehicle detector during this window then the vehicle may be allowed to continue. In addition, however, on the occurrence of a vehicle passing a detector another window is created referred to as the coupled car time window (hereinafter CCTW). Finally, a third window is also created which is referred to as too close time window (hereinafter TCTW). If a subsequent vehicle passes the first mentioned detector during the presence of the TCTW window then protective action may be required. This should be apparent to those of ordinary skill in the art for this means that a second vehicle is following too closely to the vehicle which created the TCTW. Since the system does admit of trains of vehicles, that is vehicles coupled one to another, and since each separate vehicle will be separately detected, the CCTW allows the system to distinguish between such situations in which a second vehicle follows closely behind the first because it is coupled to the first vehicle. This is, of course, not an unsafe condition and therefore if a second vehicle passes the first mentioned vehicle detector within the CCTW then no protective action is required although it will be necessary to create three additional windows for that second vehicle, i.e., the CCTW, TCTW and ASTW. FIG. 3 illustrates the temporal sequence of the three windows at any particular vehicle detector location. It should be apparent that FIG. 3 is not drawn to scale and therefore does not illustrate the relative widths of the different windows. It should also be apparent from the foregoing discussion that the CCTW which expires at time T1 is created by a vehicle passing the detector associated with this window. In like fashion the TCTW which exists between $T_1$ and $T_2$ is also created by a vehicle passing the detector with which this window is associated. On the other hand the ASTW which exists from $T_3$ to $T_4$ was created by a vehicle passing the detector which precedes the detector with which these windows are associated and is therefore illustrated below the TCTW and CCTW.

Figure 4:
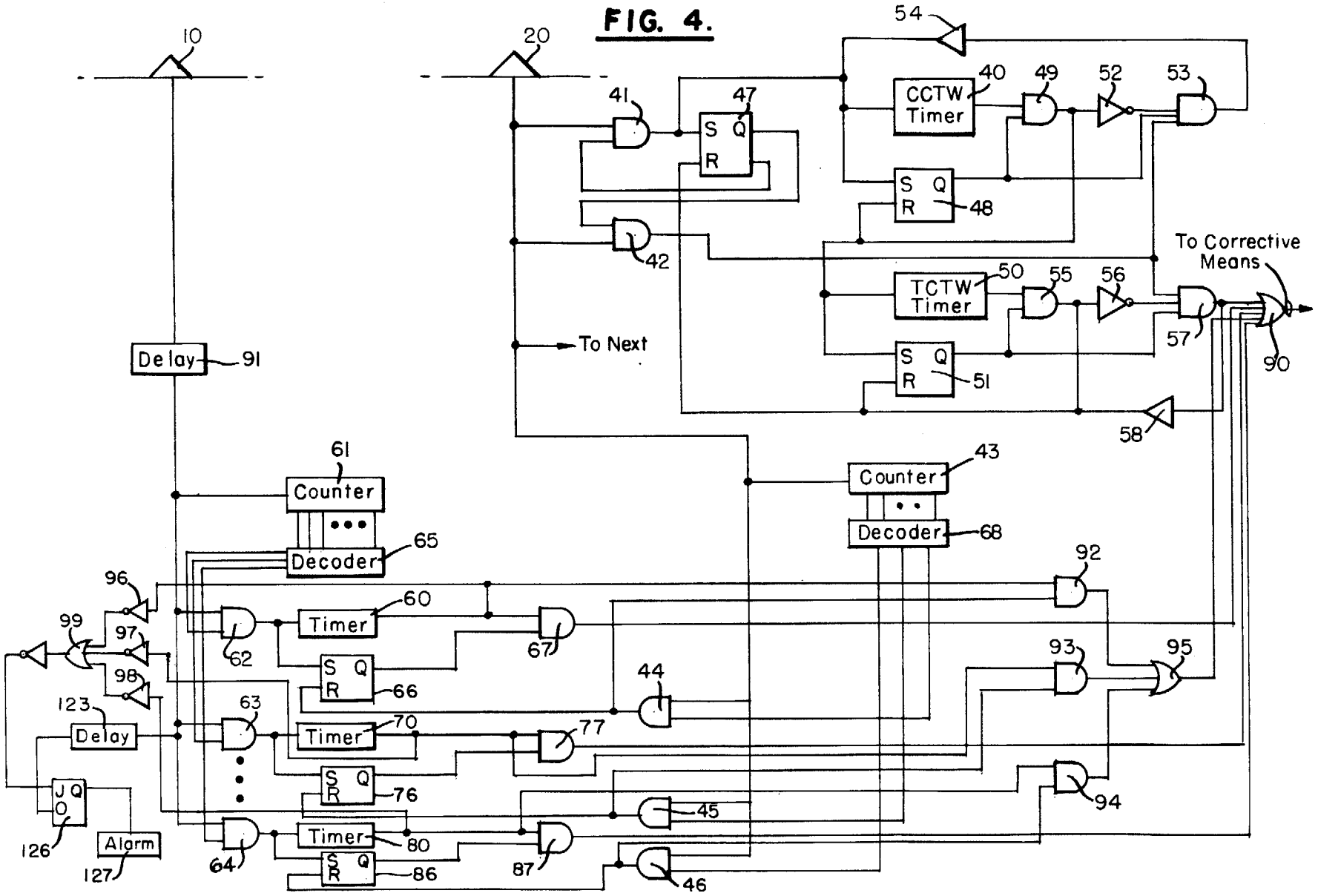
FIG. 4 is a preferred embodiment of a portion of the control system.

The control system 15 which creates the different windows, compares vehicle performance to the windows and signals the protective means 16 that the vehicles may continue or in case protective action is required can be implemented in many different forms. FIG. 4 illustrates one type of implementation. The apparatus of FIG. 4 is provided for each different detector in the system. This apparatus is, as illustrated in FIG. 4, connected not only to the detector with which the apparatus is associated but also to the preceding detector.

As shown in FIG. 4 control means 15 for any detector location comprises a plurality of timers, and associated logic apparatus to create the windows diagramatically shown in FIG. 3. In particular, associated with each detector, such as detector 20 as is illustrated in FIG. 4, is a CCTW timer 40 and a TCTW timer 50. In addition, a plurality of ASTW timers 60, 70, and 80 receive inputs both from detector 20 and the preceding detector, i.e., detector 10. The signals produced by the timers and their associated logical apparatus provides input signals to OR gate 90 the output of which is coupled to the corrective means 16 to initiate protective action under appropriate circumstances.

More particularly, the output of detector 20 is coupled to AND gates 41 and 42, a counter 43 and further AND gates 44–46. The output of AND gate 41 provides a setting input to a flipflop 47. The Q output of flipflop 47 is provided as another input to AND gate 42. The output of AND gate 41 also provides an input to CCTW timer 40 and the set input of a flipflop 48. The Q output of flipflop 48 provides one input to an AND gate 49 whose other input is provided by the output of CCTW timer 40. The output of AND gate 49 is coupled to the reset input of flipflop 48 and also to provide initiating signals for TCTW timer 50 and a setting input for flipflop 51. The output of AND gate 49 is coupled, through inverter 52, to one input of an AND gate 53. Another input to AND gate 53 is provided by the output of AND gate 42. The third input to AND gate 53 is provided by the Q output of the flipflop 48. The output of AND gate 53 is coupled, through buffer 54 to reset CCTW time 40.

The output of TCTW timer 50 is provided as one input to an AND gate 55 whose other input is provided by the Q output of flipflop 51. The output of AND gate 55 is coupled as resetting input to flipflops 51 and 47. The same output is also provided, through an inverter 56 to an AND gate 57, another input of which is provided by the output of AND gate 42. The third input to AND gate 57 is provided by the Q output of flipflop 51. Finally, the output of AND gate 57 is coupled to OR gate 90 and, through buffer 58 to the resetting inputs of flipflops 51 and 47. The foregoing apparatus provides the CCTW and TCTW windows associated with detector 20 created by the passage of any vehicle. The remaining apparatus in FIG. 4 provides the ASTW windows associated with detector 20. Since the ASTW window is initiated by passage of a vehicle past the preceding detector this apparatus is shown as receiving a signal from the preceding detector, i.e., detector 10 through delay means 91. Furthermore, since there may be a plurality of vehicles traveling between detectors 10 and 20 at any point in time a plurality of timers are provided. It will be apparent from the following description that although plural vehicles may be simultaneously traveling between a pair of detectors all such vehicles must be coupled together. Although three timers, timers 60, 70 and 80 are illustrated, those of ordinary skill in the art will understand how additional timers may be provided. In point of fact a different timer should be provided for each of the vehicles which can be traveling at any point in time between a pair of detectors. More particularly, the output of vehicle detector 10 provides an input to a counter 61 as well as an input to each of AND gates 62–64. The outputs of counter 61 are coupled to a decoder 65 which provides a plurality of outputs equal to the different states of counter 61. These different outputs of decoder 65 are provided respectively to different ones of AND gates 62–64. The output of each of AND gates 62–64 is coupled as an input to different ones of the timers 60, 70 and 80 and its associated flipflops 66, 76, and 86. The outputs of each timer and the Q output of associated flipflop are provided as the inputs to an associated AND gate including AND gates 67, 77 and 87. Each of these AND gates provides an input to OR gate 90. In addition to the signals from detector 10, this apparatus is also responsive to signals from detector 20 coupled as one input to AND gates 44, 45 and 46. Finally, the output of AND gate 44 provides a resetting input to flipflop 66, the output of AND gate 45 provides the resetting input to flipflop 76 and the output of AND gate 46 provides a resetting input to flipflop 86. The high outputs of any of AND gates 67, 77 or 87 indicate termination of the acceptable arrival time without corresponding arrival of the vehicle. AND gates 92–94 are provided to be enabled by high outputs from AND gates 44–46 and the associated timers. The high outputs of any of AND gates 92–94 indicate vehicle arrival prior to an acceptable time. Finally, inverters 96–98, OR gate 99, delay unit 123, flipflop 126 and alarm 127 monitor proper operation of the timers 60–80. Each of the timers 40, 50, 60, 70 and 80 may in fact comprise monostable multi-vibrators normally providing a high output but, which are capable of being switched to their astable state in which they provide a low output for a predetermined timing period.

Since the CCTW timer is intended to enable detection of coupled cars those of ordinary skill in the art will understand the manner in which the astable period of CCTW may be selected to provide this function. Likewise, since the TCTW timer is intended to enable detection of closely following cars, those of ordinary skill in the art will understand the manner in which the astable period of this multi-vibrator can be selected. Finally, timers 60, 70, 80 etc. are identical and are intended to time the period of acceptable arrival time of a vehicle traveling between different detectors. Since the vehicles are intended to travel at approximately the same speed throughout the system those of ordinary skill in the art will understand the manner in which the period of delay 91 can be selected. In its rest state each of the timers is reset, providing a high output, each of the flipflops is also reset to thereby provide a low Q output. Counters 61 and 43 are selected so that each have equal capacity and, in describing typical operation of this apparatus we will assume that the counters are synchronized, i.e., that each is providing the identical count when there are no vehicles between detectors 10 and 20.

When a first vehicle is detected at the detector 10 the signal resulting from that detection will pass one of AND gates 62–64 as selected by the output of decoder 65. The associated timer will be switched to its astable state and its associated flipflop will become set. Furthermore, counter 61 is incremented so that the next detection at detector 10 causes a different timer to be switched to its astable state. Depending upon the number of vehicles which may be traveling between detectors 10 and 20 a number of different timers may be initiated prior to the first of these vehicles reaching detector 20.

When a vehicle reaches detector 20 the signal indicating this event will be coupled through AND gate 41, inasmuch as flipflop 47 had been reset. This will cause flipflop 47 to become set and also to switch CCTW timer 40 to its astable condition and finally to set flipflop 48. At the same time the detection of that vehicle at detector 20 will enable one of AND gates 44–46, depending upon which of these is selected by decoder 68 corresponding to the present count in counter 43. Assuming that counters 61 and 43 contained the same count prior to the first vehicle reaching detector 10, then when that same vehicle reaches detector 20 counter 43 will have attained the initial count of counter 61. As a result, the signal from detector will be coupled through the appropriate AND gate to reset flipflop associated with the timer which was switched by arrival of the same vehicle at detector 10. This will occur assuming, of course, that the associated timer had not expired. If the timer expires prior to its being reset the associated AND gate is enabled to provide a signal to OR gate 90 to thereby signal the protective means. We will assume, however, that the timer had not expired, that is the vehicle had traveled from detector 10 to detector 20 within the expected arrival time. It should be apparent from the foregoing that so long as the vehicles travel between the location of detectors 10 and 20 within the expected arrival time none of the timers which had been switched to the astable conditions will expire prior to the associated flipflop being reset to thereby inhibit production of an output signal from the associated one of AND gates 67, 77 and 87.

On the other hand since delay 91 delays the arrival of a signal at one of AND gates 62–64 it is possible for a vehicle to reach detector 20 prior to the time that the signal generated by the same vehicle passing detector 10 reaches one of these AND gates. This corresponds to a vehicle traveling faster than is allowed. The apparatus previously described will normally detect this fact in the following way. The signal generated by detector 20 will enable reset of one of the flipflops associated with the timers 60–80. However since the signal from detector 10 has not yet reached any of the AND gates 62–64, the associated timer and its flipflop had not yet been set. The reset pulse will, therefore have no immediate effect. After the timer does become set, however, there will not be a reset pulse for the flipflop. This will normally result in an output from one of the associated AND gates 67, 77 or 87. Under some circumstances the foregoing action may be delayed, especially in the presence of a train of vehicles. To provide for prompt detection of early arrival gates 92–95 are provided. One input of each of AND gates 92–94 is derived from the output of the associated timer 60, 70 or 80. The other input is connected to the output of one of AND gates 44–46. One of the outputs of AND gates 44–46 will be high on detection of a vehicle at detector 20. If the associated timer is not, at that time, in its astable condition a one of AND gates 92–94 will produce a high output indicating early arrival. This will result in a signal from OR gate 95 causing a signal from OR gate 90 resulting in protective action.

To monitor proper performance of the timers inverters 96–98 are connected to the outputs of the timers 60, 70 and 80. A signal coupled by delay 91 should put one of these timers in its astable condition resulting in a high output from one of the inverters. Delay 123 is provided to compensate for the delays involved in operating the timer to its astable condition. Flipflop 126 monitors the output of OR gate 99 on the transitions of the output of delay 123. Alarm 127 is initiated unless the output of gate 99 is high indicating that at least one timer is in its astable condition. The alarm may be employed to trigger protective action.

As was indicated above, the CCTW timer is timing and, if that timer expires prior to detection of a second vehicle AND gate 49 produces an outut signal to switch TCTW timer 50 to its astable condition and to also reset flipflop 48. Assuming that a vehicle is not detected prior to the time that TCTW timer 50 expires then AND gate 55 would be enabled to thereby reset both flipflops 51 and 47.

On the other hand, if a second vehicle is detected passing the location of detector 20 prior to the time that CCTW timer 40 expires, the signal indicating passage of that vehicle will pass AND gate 42 (which had been enabled by reason of the set state of flipflop 47). Since CCTW timer had not expired the output of AND gate 49 will be low and thus the output of inverter 52 will be high. The third input to AND gate 53 is provided by the high Q output of flipflop 48 and thus AND gate 53 is enabled to restart CCTW timer 40 through buffer 54.

If, on the other hand, a second vehicle is detected by detector 20 subsequent to the time that CCTW timer 40 expires but prior to the time that TCTW timer 50 expires the following event will occur. AND gate 57 will be enabled instead of AND gate 53. The high output of AND gate 42 provides one input to AND gate 57, the high output of inverter 56 provides a second input and the high output of flipflop 51 provides a third input. This is, in effect an error condition because it indicates that the second vehicle is following too closely upon the first. Thus, AND gate 57 provides an input to OR gate 90 to thereby signal the protective means to take appropriate action. At the same time, flipflops 51 and 47 are reset through buffer 58 so that the apparatus will be in proper condition for further operation.

Thus it should be apparent the apparatus illustrated in FIG. 4 creates the windows diagrammatically shown in FIG. 3 and detects whether or not vehicles are traveling at proper speeds and with minimally acceptable seperation. Although this apparatus includes a CCTW timer initiated by vehicle detection and a TCTW timer initiated by expiration of the CCTW timer those skilled in the art will perceive that the TCTW timer could, just as well, be initiated by vehicle actuation as well.

Although the apparatus illustrated in FIG. 4 is effective to carry out the necessary monitoring functions these same functions can, under certain circumstances, be carried out more economically by employing digital computer means to carry out the functions of control system 15. There are many digital computer means which could be employed including those popularly known as mini-computers. Thus, for instance, Data General nova computer could be employed in one typical embodiment. The control system 15 in monitoring the safety of the system should, of course, be designed to fail-safe. One checking technique is shown in FIG. 4 for exemplary purposes, i.e., inverters 96–98, alarm 127 and associated apparatus. Those of ordinary skill in the art will realize that other well-known techniques can be employed either in addition to the technique illustrated or in place thereof. A substantial segment of the industry, however, has not yet accepted a computer as a fail-safe device or component. For this reason the term digital computer means is employed. This term may refer to a single digital computer but it may also refer to a plurality (at least two) digital computers which may check the functioning of each other. One simple way to ensure such checking is to have each computer perform the identical operation and only accept the output if they are identical. Other methods of checking may also be used. In addition to providing the selected computer means with the inputs corresponding to actuation of the various vehicle detectors 10, 20, 30, 40 etc. the computer must also be provided with an appropriate program so as to enable the computer to respond properly to the different inputs and provide an appropriate input to protective means 16 when required.

Figures 5A, 5B, 7:
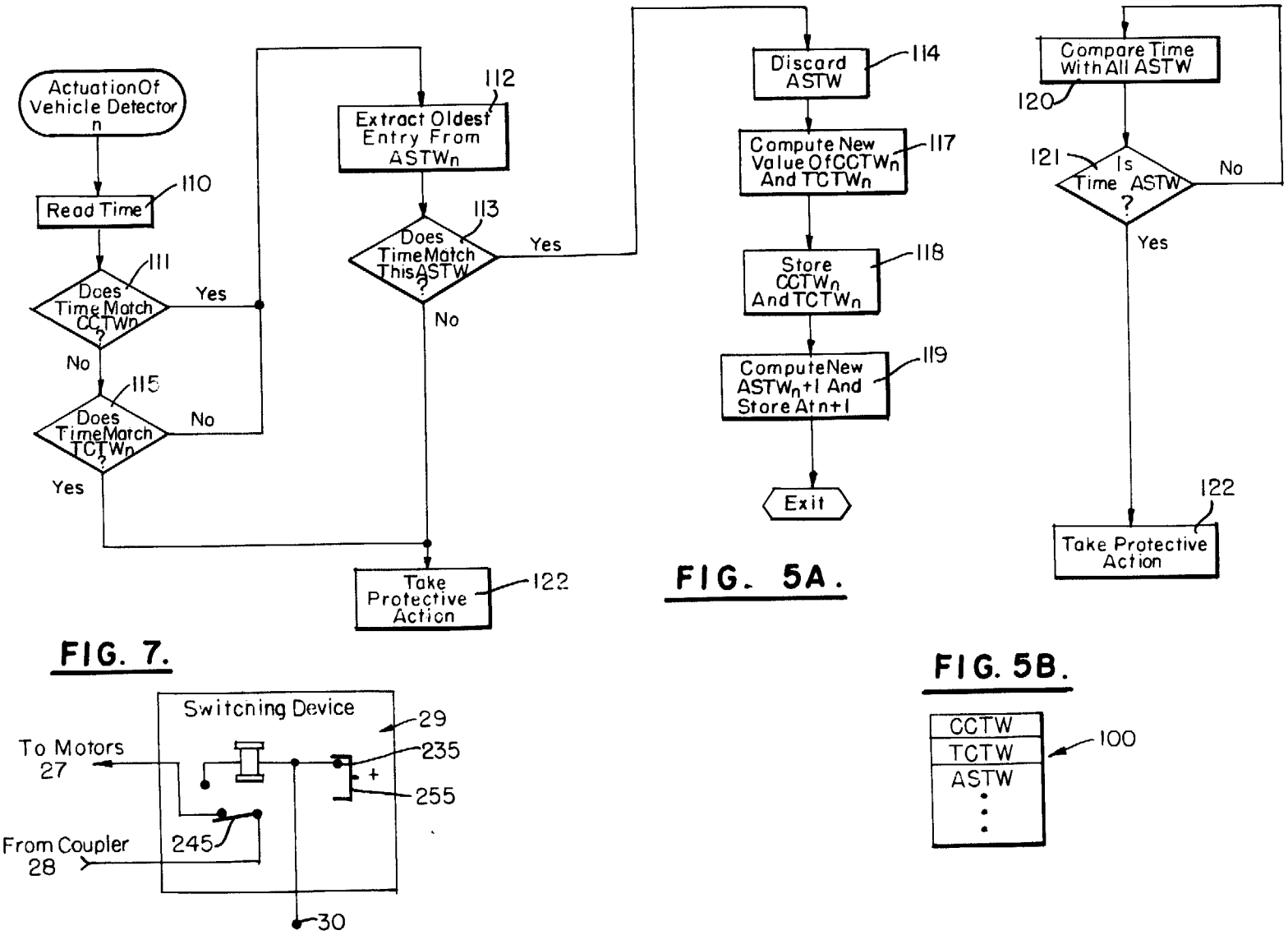
FIG. 5A is a flow diagram for a program employed in another preferred embodiment and FIG. 5B illustrates allocation of memory.
FIG. 7 is a detailed showing of a portion of vehicle carried apparatus.

FIG. 5A illustrates a flow diagram for such an appropriate program. Prior to discussing the manner of operation of this program the reader should refer to FIG. 5B which illustrates, in diagramatic form, the manner in which portions of the computer memory are allocated. More particularly, a block of memory capacity is set aside for each of the different detectors in the system. Such a block 100 is illustrated in FIG. 5B. It will be seen that block 100 is further subdivided into a CCTW portion, a TCTW portion and an ASTW portion. Thus, each of the detectors in this system will have a corresponding memory block 100. Into the CCTW portion of this memory block will be written data identifying the CCTW window. Correspondingly, into the TCTW portion of memory block 100 will be written data corresponding to the TCTW window. And, furthermore, into the ASTW portion of memory block 100 will be written data identifying one or more ASTW periods. The manner in which this data is generated, read and stored will become apparent from the description of the program which is illustrated in FIG. 5A.

The program illustrated in FIG. 5A comprises two portions one of which is initiated upon each actuation of each of the different vehicle detectors, and the second portion of which performed on a periodic basis. The first portion of the program illustrated in FIG. 5A is responsive to the actuation of any vehicle detector. For purposes of this description we will assume that any vehicle detector has detected the presence of a vehicle. This results in an input signal to the computer and, knowing the identity of the vehicle detector which has been actuated the program is initiated. The identification of the vehicle detector which has provided the input may be determined in a number of ways. If each detector provides an input on a separate conductor, obviously the conductor which is energized or which provides the signal provides the identification of the vehicle detector which has been actuated. On the other hand, if the vehicle detector signals are coupled to the computer in a multiplex fashion, the demultiplexer would provide information as to which vehicle detector provided the input signal. The first function in the program, 110 is to read the clock to obtain a designation of the time at which the actuation occurred. Decision point 111 determines whether or not the time just read matches the data stored at CCTW for the associated detector. In some cases it may be appropriate to store, at CCTW data identifying the beginning and ending times for the CCTW. Thus, decision point 111 will determine if the time determined at step 110 lies between these limits. On the other hand, it may be sufficient merely to provide in the CCTW time identifying the termination of the CCTW and in that case decision point 111 will determine whether or not the time read is less than or equal to the data stored at CCTW. Assuming the time read is less than or equal to the data stored at CCTW, the system that has determined that the actuation occurred by reason of a coupled car and thus the computer is directed to perform function 112. This function extracts the oldest entry from the memory block 100 associated with the detector and then decision point 113 determines whether or not the time read at function 110 matches the data extracted at function 112. This decision point can be implemented in either of the manners discussed with respect to decision point 111. Assuming a match is indicated then the program directs the computer to perform function 114. Before discussion of function 114, however, we will return to decision point 111 and explain the manner in which the program operates assuming that decision point 111 determined that the CCTW did not match the time read at function 110.

In that case decision point 115 goes to the TCTW portion of the memory block 100 associated with the actuated detector and determines if the time read at function 110 matches this data. In this case the program directs computer to function 112 assuming a match is not indicated. If a match is indicated it means that the detected vehicle is following too closely to the preceding vehicle and the program is directed to function 116 to take protective action.

Assuming that the CCTW, TCTW and ASTW checks are made (at decision points 111, 113 and 115) and indicate that a TCTW criteria was not violated and the vehicle has reached the location within the ASTW then function 114 directs the computer to discard the ASTW entry extracted at function 112. Function 117 then computes new values of CCTW and TCTW. In any particular system the CCTW and TCTW periods will be constant and therefore function 117 is merely adding the respective constants to the time read at function 110. Once these functions have been accomplished function 118 stores the now computed values in the appropriate portion of the memory block 100 for the associated detector. Function 119 then computes a new ASTW for the arrival of this vehicle at the next subsequent detector. In the same manner that CCTW and TCTW are constants for a system the ASTW will also be a constant and therefor the computation indicated at function 119 is merely adding the constant factor to the time read at function 110 and storing it in the appropriate location. Of course, the appropriate location is the ASTW portion of memory block 100 associated with the detector subsequent to the actuated detector. With the completion of function 119 the routine is completed and the computer awaits subsequent actuation of this or other vehicle detectors.

The other portion of the routine illustrated in FIG. 5 may be performed on a periodic basis. The major portion of that routine is performed at function 120 where real time, that is the time read from the clock at the time of executing the function, is compared with an ASTW entry to determine if the ASTW window has expired. Under normal circumstances it will be sufficient to examine only the oldest ASTW entry in a memory block 100. Function 121 determines if the time read is greater than ASTW and if not the routine loops back to function 120 to compare the time read with other ASTW values. If, however, the time read is greater than the ASTW, than the ASTW has expired and the routine directs the computer to function 122 to take protective action.

In the embodiment illustrated in FIG. 4, as well as the embodiment illustrated in FIGS. 5A and 5B it has been indicated that vehicles are allowed to continue their travel unless violation of the TCTW or ASTW is detected which results in protective action. In the embodiment of FIG. 4 the protective action results from initiating corrective means 16. In the embodiment of FIGS. 5A and 5B the digital computer may likewise initiate corrective means 16. Corrective means 16 may comprise a relay or the like switching device which normally maintains the circuit between the power source 17 and the power conductor 18. Detection of a window violation terminates this circuit. This will of course, remove power from each and every one of the vehicles which is drawing power from the conductor 18 to thereby bring each of the vehicles to a stop.

On the other hand, as the following discussion will illustrate, the system may forgive a single violation of the TCTW or ASTW requirement or a number of violations less than some predetermined maximum.

The control system schematically represented in FIG. 1 can be analyzed as a block system with check in-check out characteristics. Any vehicle whose speed falls below required speed or above that speed, by more than the specified tolerance, as determined by the ASTW, is detected by its failure to arrive at the next vehicle detector at the proper time. A vehicle which tends to follow the preceding vehicle with less than safe braking distance (as determined by TCTW) is detected by its premature arrival at a vehicle detector. Since the logic of this apparatus requires actuation at specific times and no actuation at other times, failures of the detectors themselves and the data links connected to the detectors with the control system 15 is easily detected. As a result, the detectors and communication links need not meet stringent failure mode requirements so far as safety is concerned. Block length, i.e., the distance between pairs of detectors, is a factor in minimum headway determination since the time for failure detection can be increased by as much as the normal travel time through a block. In one embodiment typical block lengths might be 25 feet, for example, adding one second to failure detection time assuming a 25 foot per second vehicle speed. Where speeds are lower, of course, shorter blocks may be in order. The control system 15 may safely forgive an extra or a missed detector actuation in the event that subsequent actuation appear to be proper by either employing shorter blocks or increasing the minimum headway between vehicles to allow for the increase in failure detection times. For instance, if we assume that a minimum block length is taken to be equal to the safe braking distance, that is, if power is removed when a vehicle is adjacent a detector 10 the vehicle will be safely stopped prior to reaching the detector 20, and further assume that the TCTW period is equal to the time it takes the vehicle to travel a distance equivalent to two block lengths, then the control system can safely forgive a single TCTW violation and only take the protective action indicated above if the subsequent vehicle detector indicates that the associated vehicle has again violated the TCTW period. Those of ordinary skill in the art will understand how various combinations of the duration of TCTW, minimum headway and the ability to forgive single or multiple violation can be combined to provide a system which meets safety requirements.

Figure 6:
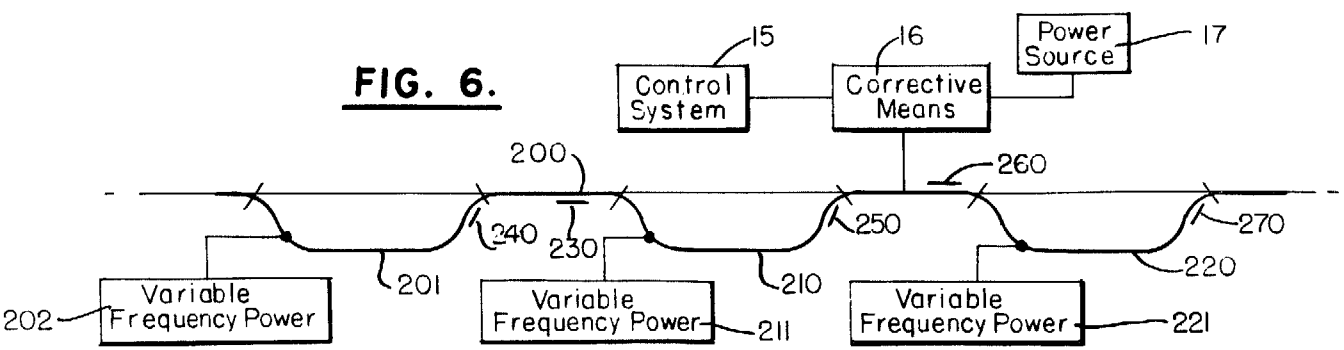
FIG. 6 is a block diagram of a system employing the invention.

Since a system illustrated in FIG. 1 requires all vehicles to travel at approximately the same speed some apparatus must be provided, if a system is to have the capability of loading and unloading the vehicles, of slowing down the vehicles and stopping them for loading and unloading purposes and bringing the vehicles up to the speed required by the system diagramatically illustrated in FIG. 1. FIG. 6 illustrates the manner in which these functions can be accomplished. In FIG. 6 like reference characters identify identical apparatus. In FIG. 6, 200 identifies the main line guideway the power to which is controlled by the apparatus previously mentioned which derives information from a plurality of detectors spaced along the main line 200 which are themselves not illustrated. A plurality of turnouts, 201, 210 and 220 are illustrated which are cooperatively associated with the main line such that vehicles 25 may be selectively switched onto or off the main line 200 at the switching locations. As is diagramatically illustrated in FIG. 6 the power supply conductor is insulated from the portions of the power supply conductors adjacent the turnouts. In the turnout areas vehicle speed may be varied. For example in the case where the vehicle motors are induction motors, each of the turnouts are supplied with power whose frequency is variable to thereby control the speed of vehicles traveling on the turnout. Each turnout preferably has at least one, and perhaps a plurality of stopping areas for different vehicles, for loading and unloading purposes. As the vehicle enters the turnout the variable frequency power supply is supplying power at a frequency close to or slightly less than the frequency of power on the main line. As the vehicle travels in the initial portions of the turnout and approaches a first stopping area the frequency of the power supplied to the vehicle may be decreased to gradually slow the vehicle down. When it is desired to move the vehicle, after loading and/or unloading has occurred, the frequency of the power source is gradually increased to propel the vehicle at increasing speeds. The variable power source associated with any turnout is controlled so that the speed achieved by the vehicle when it again approaches the main line is the speed required by the vehicle traveling on the main line. Appropriate apparatus can be provided to interlock the control system 15 with the variable power supply associated with any turnout such that vehicles are only released from the turnout to enter the main line when other vehicles are at least safe braking distances away from the merging point in both directions. Such apparatus is well known to those skilled in the art and can comprise, for example, systems of the type disclosed in U.S. Pat. Nos. 3,788,232; 3,263,073 or 3,263625.

For switching purposes, that is for selectively allowing the vehicle 25 to either remain on the main line 200 or to diverge on to one of any number of turnouts, on board switching apparatus may be used such as that disclosed in applicant's co-pending application Ser. No. 494,433 filed Aug. 5, 1974, now U.S. Pat. No. 3,963,688 entitled Short Headway Switching System the disclosure of which is herein incorporated by reference. The on board switching apparatus disclosed in that application includes a direction determining member on board the vehicle which is capable of assuming one of two different positions for determining whether or not the vehicle will diverge at a switch point. As disclosed in that application one essential requirement for employing on board switching equipment is to assure that when a vehicle approaches a switch point the switching mechanism on board the vehicle is locked. Otherwise the vehicle will travel in an indeterminate path through the switch point. FIG. 2 illustrates schematically such a switching device 29 which is included in the power supply circuit to motor 27. Normally, only when the switching device 29 is locked in either one of its two possible positions, will power be transferred to the motor 27 to provide for propulsion of the vehicle. Thus, normally if the switching device 29 becomes unlocked the vehicle automatically comes to a stop. However, in advance, and subsequent to, a diverge switch point it may be necessary to actually shift the position of the switching device from one to its other position. In order to maintain travel of the vehicle during this transition in a safe fashion brush 30 is provided to receive signaling energy from intermitently located signalling elements, located in advance and subsequent to such diverging of switch points. Such elements are diagramatically illustrated in FIG. 6 as 230, 240, 260, and 270 etc. Thus, for instance, switching device 29 may include a relay or the equivalent which is maintained in an energy transmitting condition when the switching device is locked. This relay or the equivalent may be maintained in an energy transmitting condition in the event that the switching device 29 becomes unlocked if signalling energy is provided to brush 30. Thus, in the regions of the pathway in which the signal supplying conductors 230, 240, 250, 260 and 270 are provided, a switching device 29 may be maintained in an unlocked condition and at the same time allow power to be transmitted to the motor 27. However, it should be apparent to those skilled in the art that when the vehicle reaches termination of the signal supplying conductors the switching device must be in its locked condition or the supply of power to the motors will be interrupted. A simple implementation of that apparatus is illustrated schematically in FIG. 7. More particularly, power must be supplied to relay terminal 235 in order to maintain relay contact 245 closed to complete the power supply circuit to the motor 27. Such energy may be supplied, and is normally supplied from plus over the switching contact 255 to the terminal 235. Alternatively power may be supplied over brush 30 to relay terminal 235 and so long as such power is supplied a switching device 29 can be unlocked during which time switching contact 255 is not in electrical contact with terminal 235.

What is claimed is:

1. A control system for monitoring operation of a plurality of self-propelled vehicles moving along a guideway for assuring safety of operation, comprising;

a plurality of vehicle detectors at predetermined locations along said guideway for detecting passage of a vehicle, means responsive to actuation of one of said detectors by a leading and a trailing vehicle for determining time separation between said vehicles, and for allowing continued vehicle travel if actual time separation is greater than a first predetermined time period.

2. The apparatus of claim 1 in which said means further detects said time separation less than a second predetermined time period, indicative of coupled vehicles, and initiates protective action if and only if said time separation is less than a first predetermined time period and greater than said second predetermined time period.

3. The apparatus of claim 2 wherein said means includes, means for timing said second predetermined time period from receipt of a first vehicle detector actuation, means for timing said first predetermined time period from receipt of said first vehicle detector actuation and means for initiating said protective action if and only if a second vehicle detector actuation is detected after expiration of said second time period and before expiration of said first time period.

4. The apparatus of claim 3 which includes further means to monitor travel time of said vehicles between successive detectors and for allowing continued vehicle travel if said travel time is within an acceptable time period and for initiating protective action if said travel time is less than a predetermined third time period or greater than a predetermined fourth time period.

5. The apparatus of claim 4 in which said further means includes means for detecting a vehicle passing a first detector, means for timing said third predetermined time period subsequent to vehicle detector actuation at said first detector, means for timing said fourth predetermined time period from the expiration of said third predetermined time period, means for detecting said vehicle passing the next subsequent detector and for allowing continued vehicle travel if, and only if, said vehicle passes said next detector between said third and fourth predetermined time periods.

6. The apparatus of claim 5 in which said further means includes a plurality of timing means, each of said plurality of timing means responsive to a different vehicle.

7. The apparatus of claim 1 wherein said means for allowing continued vehicle travel or for initiating protective action includes means for stopping said vehicles.

8. The apparatus of claim 7 wherein said means for initiating protective action includes means for de-energizing propulsion motors driving said vehicles.

9. A control system for monitoring operation of a plurality of self-propelled vehicles moving along a guideway for assuring safe operation, comprising;

a plurality of vehicle detectors at predetermined locations along said guideway, means for comparing the travel time of a vehicle between a first and second of said plurality of vehicle detectors and for allowing continued vehicle travel if said travel time is greater than a first predetermined time period or less than a second predetermined time period.

10. The apparatus of claim 9 which includes further means to determine time separation between adjacent vehicles for allowing continued vehicle travel if said time separation is greater than a third predetermined time period.

11. The apparatus of claim 10 in which said further means allows said continued travel if said time separation is greater than said third predetermined time period.

12. The apparatus of claim 10 in which said means for allowing continued vehicle travel includes means for stopping said vehicles.

13. The apparatus of claim 12 wherein said means for stopping said vehicles includes means for de-energizing propulsion motors driving said vehicles.

14. The apparatus of claim 9 which includes a plurality of timing means, each of said plurality of timing means timing the travel of a single vehicle of a number of vehicles which may be traveling between said first and second detectors.

15. A method of ensuring safe operation of vehicles traveling along a guideway in which a plurality of vehicle detectors are spaced along said guideway for detection of vehicles passing said detectors comprising the steps of:

a. detecting passage of a vehicle at a detector, b. detecting passage of a subsequent vehicle at said detector, c. comparing the time separation between said detections with a first predetermined time period, and d. allowing continued vehicle travel if said time separation is greater than said predetermined time period.

16. The method of claim 15 wherein said step (d) is not performed if said time separation is less than a second predetermined time.

17. The method of claim 15 which includes the further step of:

detecting passage of said vehicle at a detector located adjacent said detector in the direction of travel of said vehicle, comparing the transit time of said vehicle between said detectors, and allowing continued vehicle travel if said transit time exceeds a third predetermined time period.

18. The method of claim 17 in which continued vehicle travel is allowed if, and only if said transit time exceeds said third predetermined time period and is less than a fourth predetermined time period.

19. The method of claim 15 which includes the further step of:

timing the period subsequent to passage of said vehicle past said detector and prior to said vehicle reaching a detector adjacent said detector in the direction of travel of said vehicle, and allowing continued vehicle travel if and only if said period exceeds a third predetermined time period and is less than a fourth predetermined time period.

* * * * *